US005597248A

United States Patent [19]

Burgin

[11] Patent Number: 5,597,248

[45] Date of Patent: Jan. 28, 1997

[54] INK RIBBON CASSETTE

[75] Inventor: Markus Burgin, Uster, Switzerland

[73] Assignee: Pelikan Produktions AG, Egg, Switzerland

[21] Appl. No.: 430,077

[22] Filed: Apr. 27, 1995

[30] Foreign Application Priority Data

Apr. 27, 1994 [DE] Germany ..... 9407018 U

[51] Int. Cl.[6] ..... B41J 35/28

[52] U.S. Cl. ..... 400/207; 400/208

[58] Field of Search ..... 400/207, 208, 400/208.1, 234, 231, 223

[56] References Cited

U.S. PATENT DOCUMENTS

| | | | |
|---|---|---|---|
| 4,010,839 | 3/1977 | Guerrini et al. | 400/207 |
| 4,210,296 | 7/1980 | Frechette | 400/208 |
| 4,413,919 | 11/1983 | Applegate et al. | 400/208 |
| 4,798,490 | 1/1989 | Watanabe | 400/223 |
| 4,990,008 | 2/1991 | Hwang | 400/208 |
| 5,399,035 | 3/1995 | Nakae | 400/207 |
| 5,433,540 | 7/1995 | Alday | 400/207 |
| 5,455,617 | 10/1995 | Stephenson et al. | 400/207 |

*Primary Examiner*—Edgar S. Burr
*Assistant Examiner*—Anthony H. Nguyen
*Attorney, Agent, or Firm*—Fay, Sharpe, Beall, Fagan, Minnich & McKee

[57] ABSTRACT

An ink ribbon cassette is provided for feeding and driving an ink ribbon in a printer or the like. The cassette includes a housing, a take-up core rotatably supported in the housing with the front end of the ink ribbon being coupled thereto and a take-off core rotatably supported in the housing. An ink spool is wound up on the take-off core, where the ink spool includes an outer periphery. A brake assembly is provided and includes a conical plate where the outer periphery of the ink spool rests on the conical plate, thereby decreasing the braking torque as the spool diameter decreases.

15 Claims, 3 Drawing Sheets

Fig. 1
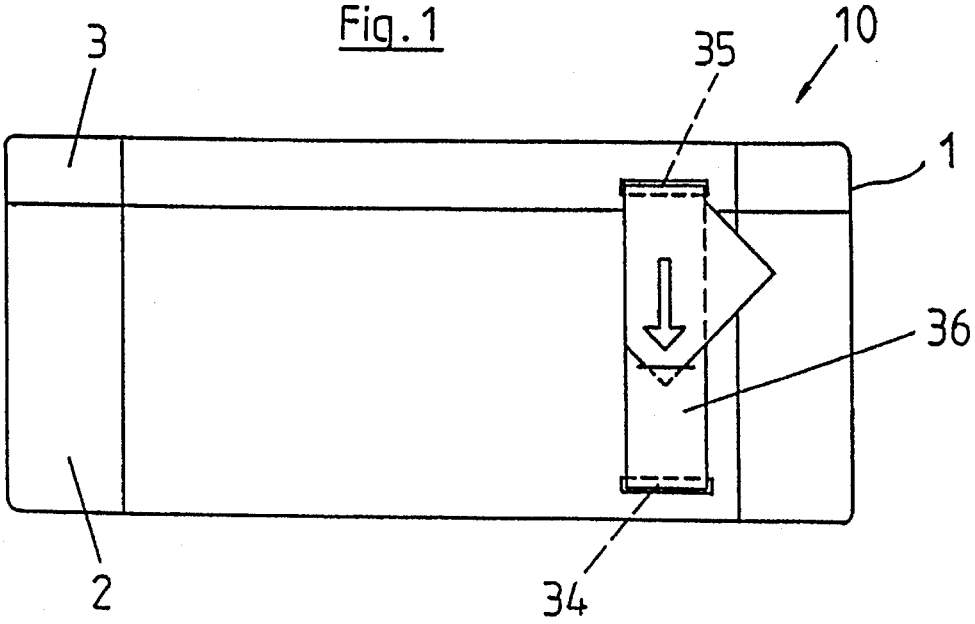
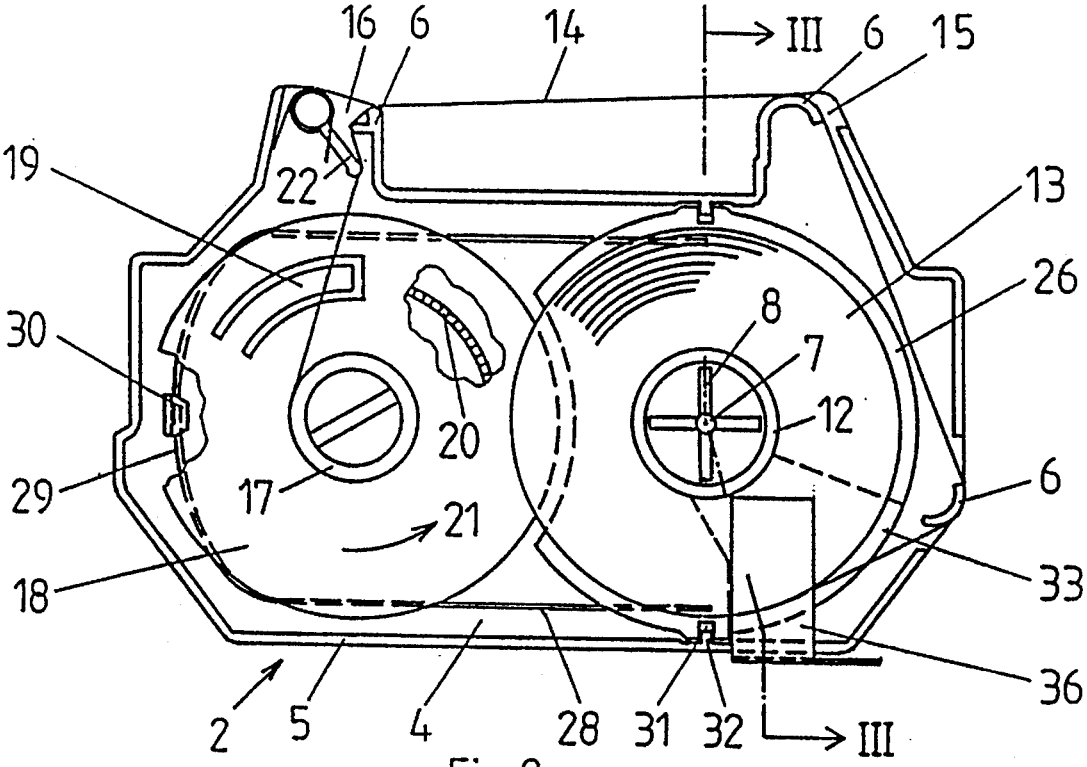
Fig. 2

INK RIBBON CASSETTE

BACKGROUND OF THE INVENTION

This invention is directed to an ink ribbon cassette and, in particular, to an ink ribbon cassette for a franking machine or the like that controls the braking pressure on the take-off spool for the ink ribbon as the spool decreases in diameter.

An ink ribbon cassette for printing, and in particular, for franking machines are known in the prior art. These cassettes include a housing, a take-up core rotatably mounted in the housing, an ink ribbon spool wound up on a take-off core rotatably mounted in the housing and a brake component. The front end of the ribbon is fastened to the take-up core. The take-off core is arranged in the housing so as to be rotatable with a ribbon spool. The ribbon is drawn from the spool by way of ribbon guide components on two projecting housing legs. A spring generating a constant braking moment presses against the take-off core. As a result thereof, the ribbon tension increases with the decreasing spool diameter causing malfunction.

Accordingly, it is desired to provide an improved ink ribbon cassette which controls the braking force imparted on the ink ribbon spool as the ink ribbon spool decreases in diameter.

SUMMARY OF THE INVENTION

Generally, speaking, in accordance with the invention, an ink ribbon cassette for feeding and driving an ink ribbon in a printer is disclosed. The cassette includes a housing, a take-up core rotatably mounted in the housing with the front end of the ink ribbon being attached thereto, and take-up core rotatably mounted in the housing. An ink spool is wound up on the take-off core, where the ink spool includes an outer periphery. A brake assembly is provided and includes a conical plate where the outer periphery of the ink spool rests substantially on the conical plate, thereby decreasing the braking torque as the spool diameter decreases.

Accordingly, it is an object of the invention to provide an improved ink ribbon cassette for printers and franking machines.

It is another object of the invention to provide an ink ribbon cassette where the braking pressure decreases with a decreasing spool diameter.

It is still another object of the invention to provide an ink ribbon cassette where the tension on the spool remains approximately constant independent of the spool diameter.

It is still another object of the invention is to provide an ink ribbon cassette having a reloadable unit which is both inexpensive and recyclable.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a side elevational view of an ink ribbon cassette in accordance with the invention;

FIG. 2 is a top plan view of the ink ribbon cassette of FIG. 1 with the lid removed;

DETAILED DESCRIPTION OF THE PREFERRED EMBODIMENTS

An ink ribbon cassette of FIG. 1, generally indicated at 10, and constructed in accordance with the invention is depicted. Ink ribbon cassette 10 includes a housing 1 having a lower part 2 and a lid 3. Lid 3 is removed from housing 1 in FIG. 2.

Figure 3:
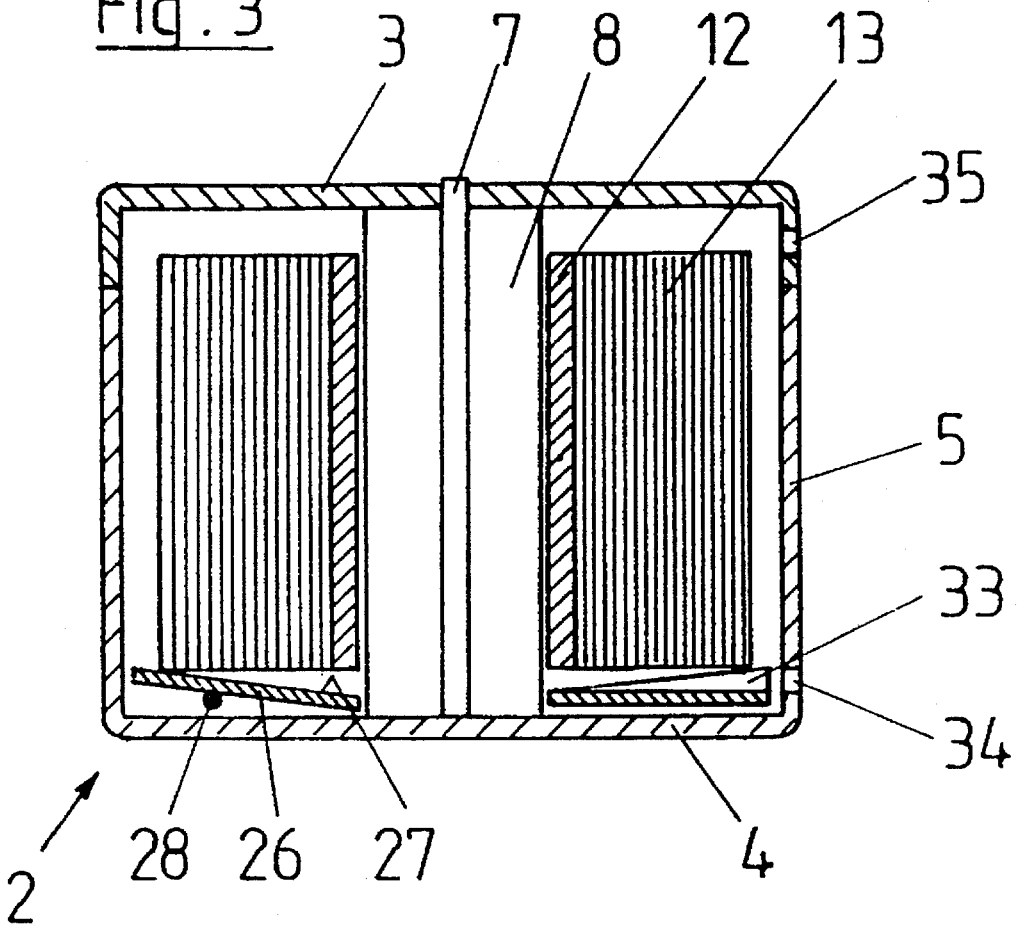
FIG. 3 is a sectional view along lines III—III of FIG. 2.
Figure 6:
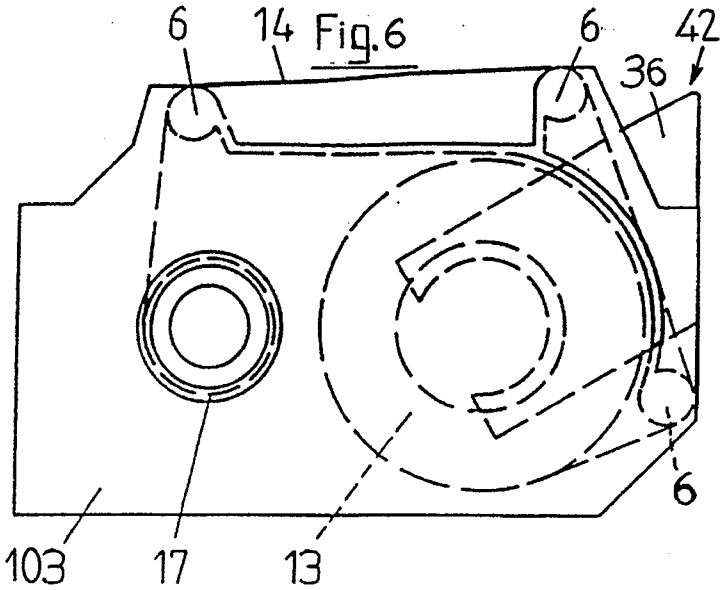
FIG. 6 is a top plan view of a reloading unit in accordance with the invention.
Figure 7:
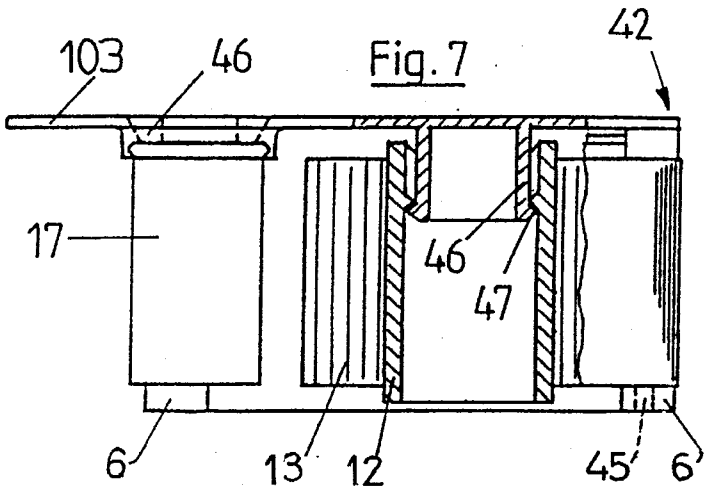
FIG. 7 is a sectional view along line VII—VII of FIG. 6.
Figure 4:
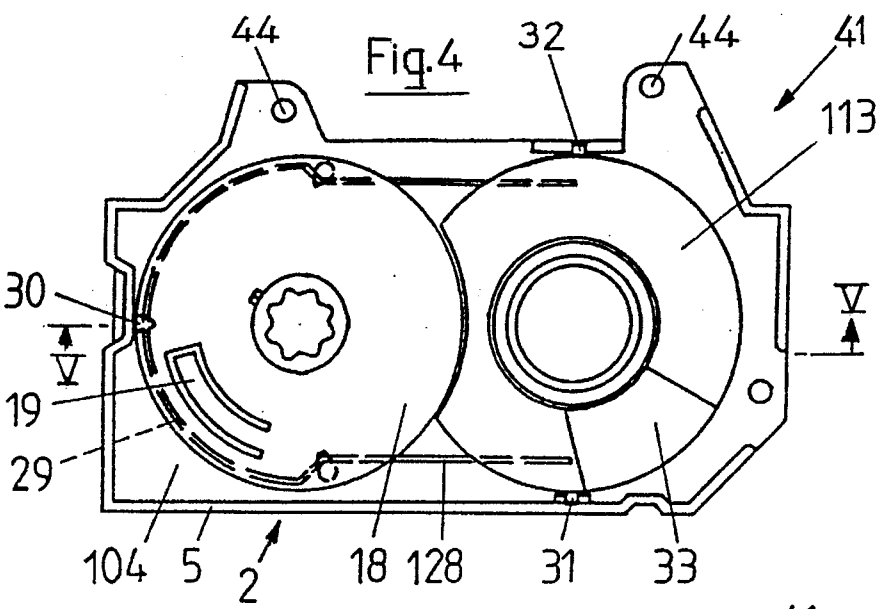
FIG. 4 is a top plan view of an adapter in accordance with the invention.
Figure 5:
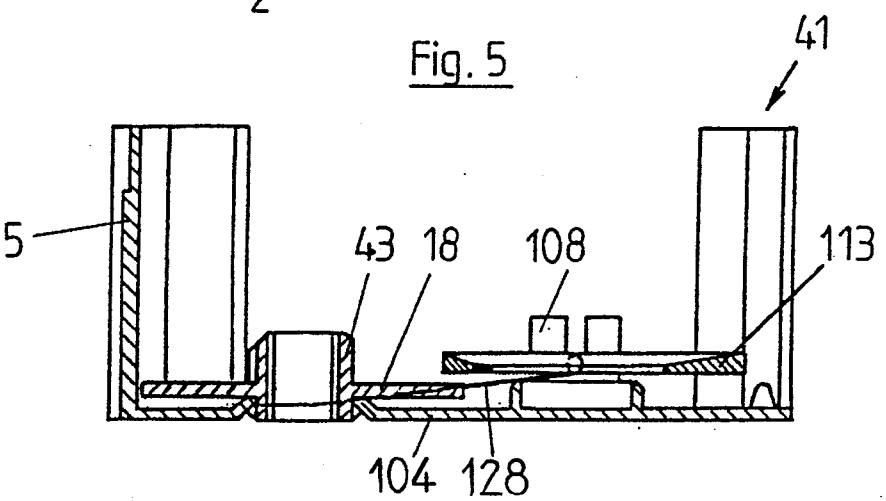
FIG. 5 is a sectional view along lines V—V of FIG. 4.

Referring now to FIGS. 1–3, lower part 2 includes a bottom 4 and lateral walls 5. Lateral walls 5 are attached to lower part 2, ribbon guide components 6, centering spigots 7 and a core guide 8. Centering spigots 7 are used to position and center lid 3. A core 12 of a ribbon spool 13 is supported and rotatably mounted on core guide 8. An ink ribbon 14 is guided from ribbon spool 13 via ribbon guide components 6, an exit slot 15, and an entry slot 16 to a take-up core 17o Take up core 17, to which the front end of ink ribbon 14 is fastened, is supported and rotatably mounted in housing 1.

Take-up core 17 is tip-stretched to a flat disk 18 from which a spring-loaded tongue 19 projects downward. The free end of tongue 19 engages an annular rim 20. Annular rim 20 includes saw teeth tip-stretched on floor 4 of housing 1, which prevents the rotation of take-up core 17 opposite to a take-up direction 21. Ink ribbon 14 is guided over a spring-loaded lever 22, located adjacent to entry slot 16, which prevents a slackening of ink ribbon 14 under jerky rotations of take-up core 17.

As shown in FIG. 3, ribbon spool 13 rests exclusively with its outer periphery on a plate 26 having a slightly conical upper surface 27. Plate 26 is pressed against ribbon spool 13 by means of a U-shaped bending spring 28 (FIG. 2) made from spring wire. A bridge 29 of spring 28 rests on bottom 4 of housing 1 and snaps into cam 30 of lower part 2. The two legs of spring 28 are bent away from bottom 4 so that their free ends abut with initial stress on plate 26. On the periphery of plate 26 are two slots 31 engaged by bridges 32 of lateral wall 5. As a result, plate 26 is secured against rotation.

Plate 26 is provided with a recess 33 at the site where ink ribbon 14 is taken off ribbon spool 13 and is guided towards first ribbon guide component 6 with the top side of the recess lying in a radial plane in relation to the spool axis. This prevents the edge of spooled-off ink ribbon 14 from contacting plate 26 as the diameter of ribbon spool 13 decreases. The portion of wall 5 connected to lower part 2 is provided with a slot 34 running flush with recess 33. Above ribbon spool 13, lid 3 is fitted with an additional slot 35. The legs of a plate shaped cardboard strip 36, which is U-shaped, are inserted into two slots 34, 35. The legs of strip 36 are then clamped between ribbon spool 13 and recess 33, respectively, and lid 3, thereby forming a safeguard for shipping by preventing rotation of the spool and keeping its front faces level.

Reference is now made to FIGS. 4–7, analogous parts are provided with identical reference numbers. Therefore, no further discussion of the parts is necessary. An adapter 41 (FIGS. 4 and 5) and a reloading unit 42 (FIGS. 6 and 7) are depicted.

Adapter 41 and reloading unit 42 are substantially similar in function to ink ribbon cassette 10 disclosed in FIGS. 1–3, but reloading unit 42 includes releasable and recyclable parts removably inserted into adapter 41. Adapter 41 includes a bottom 104, in which a brake plate 113 is axially movable on a guiding pin 108, made short in this arrangement, a braking spring 128, and a rotatable take-up driving gear 43 with flat disk 18. Projecting from bottom 104 are a plurality centering spigots 44.

Reloading unit 42 consists of a lid 103 acting as a support, to which are tip-stretched in this form of construction, ribbon guide components 6 housing centering bores 45 for centering on spigots 44. Tip-stretched on lid 103 are downward-projecting hollow spigots 46 with latches 47 for snapping to cores 12, 17. Reloading unit 42 consists of few components, all of which can be injected-molded of the same material as ribbon 14. As a result, reloading unit 42 is both inexpensive and recyclable, thereby not causing harm to the environment. Based thereon, adapter 41, which lends itself to multiple use, contains the more expensive components.

Due to the fact that only the periphery of the spool abuts the conical plate, the braking torque decreases with decreasing spool diameter, while keeping the tension of the ribbon approximately constant independently of the spool diameter. The plate is prestressed by a spring against the spool. Alternatively, the pressing force of the spool against the plate can be generated by its own weight. In addition, the ribbon tension is slightly reduced by the slight tension release of the spring towards the end of the spool.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink ribbon cassette for feeding and driving an ink ribbon, said ink ribbon having a front end, said ink ribbon cassette comprising: a housing; a take-up core rotatably mounted in said housing, the front end of the ink ribbon being coupled to said take-up core; a take-off core rotatably mounted in said housing; an ink ribbon spool mounted upon said take-off core, said ink ribbon spool having an outer periphery, and a brake assembly having a conical plate, said outer periphery of said ink ribbon spool resting on said conical plate.

2. The ink ribbon cassette of claim 1 further comprising a spring, said conical plate being axially movable in said housing and said conical plate being prestressed against said ink ribbon spool by said spring.

3. The ink ribbon cassette of claim 1, wherein said conical plate includes a recess for reeling off said ink ribbon.

4. The ink ribbon cassette of claim 3, wherein the bottom of said recess lies in a radial plane relative to the axis of rotation of said ink ribbon spool.

5. The ink ribbon cassette of claim 4, further including a plate-shaped transport safeguard inserted into the recess for preventing rotation of said ink ribbon spool during shipping.

6. The ink ribbon cassette of claim 5, wherein the transport safeguard is U-shaped for substantially embracing said ink ribbon spool during shipping.

7. The ink ribbon cassette of claim 6, wherein said transport safeguard includes cardboard.

8. The ink ribbon cassette of claim 1, wherein said ink ribbon is guided over a spring-loaded ribbon-tensioning assembly.

9. The ink ribbon cassette of claim 7, wherein said ink ribbon is guided over a spring-loaded ribbon-tensioning assembly.

10. The ink ribbon cassette of claim 1, further including a reloading unit inserted in said housing; said take-up core, said take-off core, and said ink ribbon spool being supported in said reloading unit.

11. The ink ribbon cassette of claim 4, further including a reloading unit inserted in said housing; said take-up core, said take-off core, and said ink ribbon spool being supported in said reloading unit.

12. The ink ribbon cassette of claim 10, wherein said reloading unit includes a support having a plurality of spigots; said take-up core and said take-off core being snapped onto said spigots of said support.

13. The ink ribbon cassette of claim 11, wherein said reloading unit includes a support having a plurality of spigots; said take-up core and said take-off core being snapped onto said spigots of said support.

14. The ink ribbon cassette of claim 12, wherein said support includes at least two ink ribbon guide components, said ink ribbon guide components projecting from one side of said support, said ink ribbon being in part guided through said cassette by said ink ribbon guide components.

15. The ink ribbon cassette of claim 13, wherein said support includes at least two ink ribbon guide components, said ink ribbon guide components projecting from one side of said support, said ink ribbon being in part guided through said cassette by said ink ribbon guide components.

* * * * *